US008623269B2

(12) United States Patent
Ren et al.

(10) Patent No.: US 8,623,269 B2
(45) Date of Patent: Jan. 7, 2014

(54) HOPPER AND REDUCTION DEVICE USING THE SAME

(75) Inventors: Jian-Xun Ren, Beijing (CN); Kang-Ding Yang, Beijing (CN); Qun Chen, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 503 days.

(21) Appl. No.: 12/781,990

(22) Filed: May 18, 2010

(65) Prior Publication Data

US 2011/0042867 A1 Feb. 24, 2011

(30) Foreign Application Priority Data

Aug. 21, 2009 (CN) ..... 2009 1 0189715

(51) Int. Cl.
*C22B 3/02* (2006.01)
*F27D 99/00* (2010.01)

(52) U.S. Cl.
USPC ..... 266/171; 266/200

(58) Field of Classification Search
USPC ..... 266/256, 153, 152, 171, 200, 148, 149, 266/168, 264, 241; 432/121, 129, 261; 75/363, 596, 597
See application file for complete search history.

(56) References Cited

U.S. PATENT DOCUMENTS

| | | | | | |
|---|---|---|---|---|---|
| 2,370,812 | A * | 3/1945 | Pidgeon | 266/153 |
| 4,527,778 | A * | 7/1985 | Ishizuka | 266/171 |
| 4,749,409 | A * | 6/1988 | Ishizuka | 75/612 |
| 5,254,181 | A * | 10/1993 | Yoshino et al. | 148/231 |
| 6,814,573 | B2 * | 11/2004 | Hiramoto | 432/239 |
| 7,381,268 | B2 * | 6/2008 | Minemoto et al. | 117/216 |
| 7,513,930 | B2 * | 4/2009 | Liebaert | 75/363 |
| 7,980,447 | B2 * | 7/2011 | McGlothlan et al. | 228/104 |
| 8,142,710 | B2 * | 3/2012 | Zhang et al. | 266/171 |
| 2003/0121365 | A1 * | 7/2003 | Dover et al. | 75/369 |
| 2006/0123952 | A1 * | 6/2006 | Wilson et al. | 75/660 |

FOREIGN PATENT DOCUMENTS

| | | | | |
|---|---|---|---|---|
| CN | 2532082 | | 1/2003 | |
| CN | 101109044 | * | 1/2008 | C22B 5/00 |

* cited by examiner

*Primary Examiner* — Scott Kastler
*Assistant Examiner* — Michael Aboagye
(74) *Attorney, Agent, or Firm* — Altis Law Group, Inc.

(57) ABSTRACT

The present disclosure relates to a hopper and a reduction device using the same. The hopper and the reduction device can be used to refining a material using thermal reduction reaction. The reduction device has a body defining cavity and a hopper, wherein the hopper is slidably disposed in the cavity.

12 Claims, 6 Drawing Sheets

HOPPER AND REDUCTION DEVICE USING THE SAME

CROSS-REFERENCE TO RELATED APPLICATIONS

This application claims all benefits accruing under 35 U.S.C. §119 from China Patent Application No. 200910189715.5, filed on Aug. 21, 2009, in the China Intellectual Property Office.

BACKGROUND

1. Technical Field

The present disclosure relates to hoppers and reduction devices using the same, and particularly, to a hopper and a reduction device convenient for loading or unloading articles.

2. Description of Related Art

Presently, in industrial production, a material is usually needed to be refined using thermal reduction in a reduction device. The Pidgeon method is usually adopted for refining metal.

In the Pidgeon method, a mixture of a finely ground mineral containing certain metal elements and a finely ground reductant is usually provided. The mixture is formed into small dense briquettes. The briquettes are disposed into a vacuum reduction pot. The vacuum reduction pot is heated to a high temperature, and a metal steam is generated by a reduction reaction of the mineral and the reductant in the small dense briquettes. Then, the metal steam is conducted to a crystallizer disposed at the opening of the reduction pot to be condensed. In known art, the reduction pot is usually cylindrical, and heat is usually transmitted to the briquettes through walls of the reduction pot, when the briquettes are loaded into the reduction pot and heated. Though the briquettes contacting the walls of the reduction pot can be heated quickly, it is relatively hard to heat the briquettes in the center of the reduction pot to the reduction temperature. The reason may be that the thermal conductivity between the briquettes is relatively low, and it is difficult for the heat to be conducted from one briquette to other adjacent briquettes. In the art, it usually takes about 8 hours to 12 hours between loading the briquettes and completing the reduction. Thus, the reduction pot has low efficiency. Furthermore, after the reduction reaction, some residue is left in the reduction pot. The present reduction pot is heavy in weight, and it is difficult to move the reduction pot, remove residue, and load the briquettes.

What is needed, therefore, is to provide a hopper and a reduction device using the same, into which it is convenient to load raw material and from which it is easy to remove residue.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
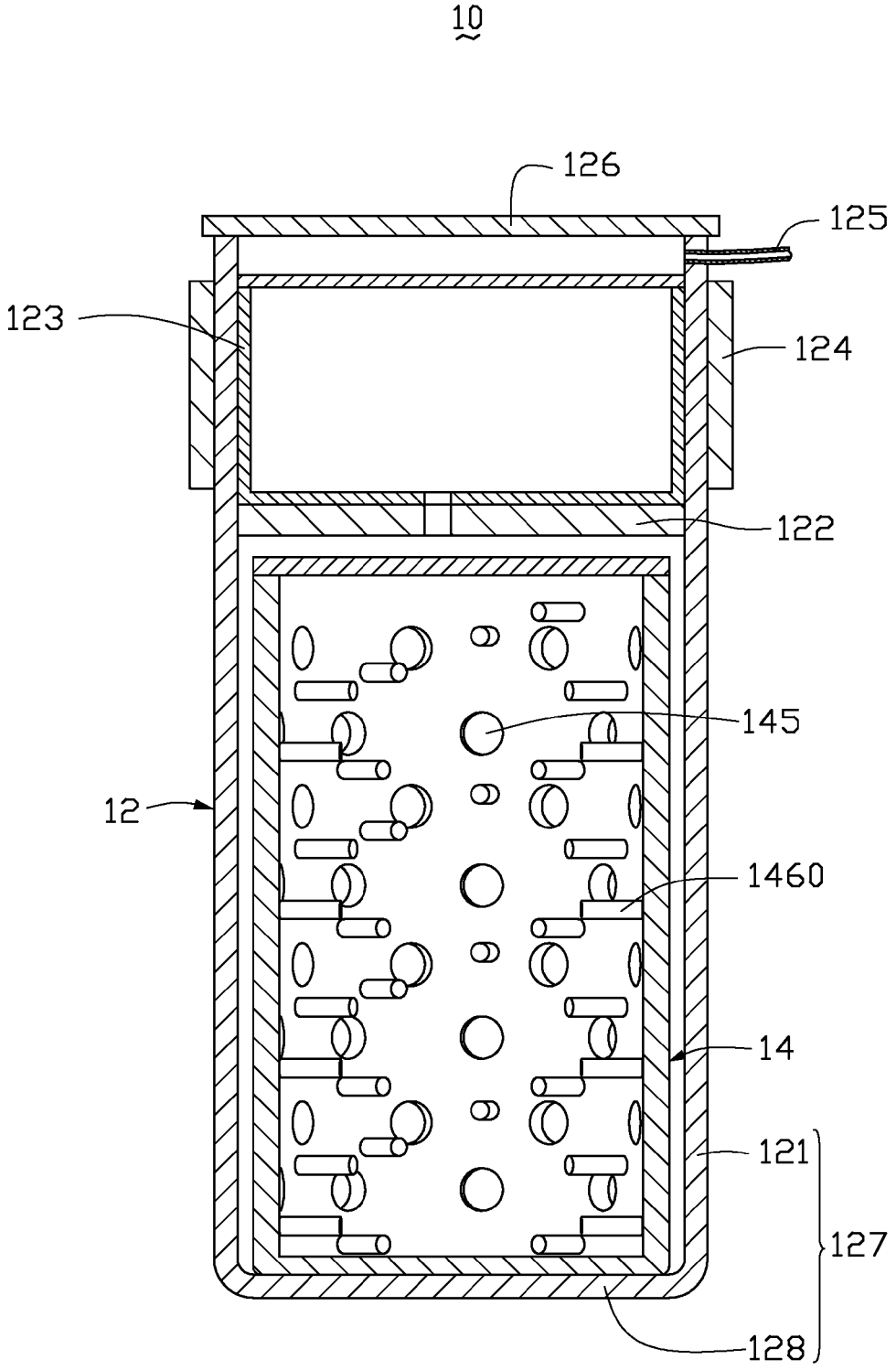
FIG. 1 is a structural schematic view of one embodiment of a reduction device, the reduction device including a hopper.
Figure 2:
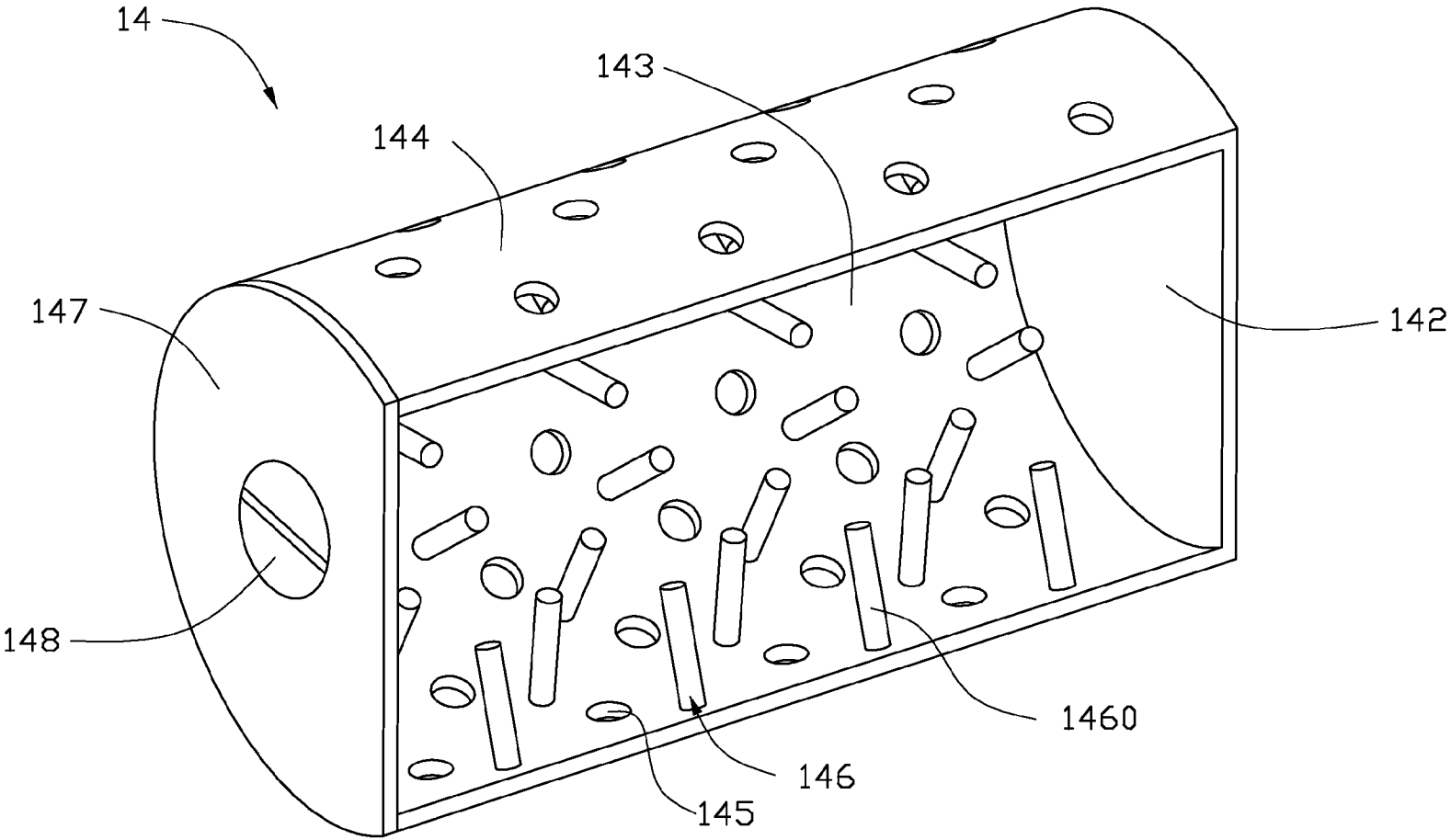
FIG. 2 is a structural schematic view of a first embodiment of a hopper used in the reduction device of FIG. 1.

Referring to FIGS. 1 and 2, one embodiment of a reduction device 10 includes a reduction pot 12 and a hopper 14 received in the reduction pot 12.

The reduction pot 12 includes a hollow cylindrical body 127, a fireproof device 122, a collector 123, a cooling device 124, and a cover plate 126. The hollow body 127 has an opening at one end (not labeled). The fireproof device 122 is disposed in the body 127 and adjacent to the opening. The collector 123 is disposed in the body 127 and located on the fireproof device 122. The cooling device 124 is attached to an outer wall of the reduction pot 12 and surrounds the collector 123. The cover plate 126 covers the opening of the body 127.

The hollow body 127 includes a bottom wall 128 and a sidewall 121 connected to the bottom wall 128. The bottom wall 128 and the sidewall 121 cooperatively define a hollow space to receive the fireproof device 122 and the collector 123. The bottom wall 128 can be a round plate. The shape of the body 127 can be cylindrical, and can be some other shape, such as cubical or frustum. The material of the bottom wall 128 and the side wall 121 can be one that has good thermal conductivity and a high thermal resistance, such as carborundum, heat resistant steel, or silicon nitride. In one embodiment, the material of the bottom wall 128 and the side wall 121 is thermal resistant steel.

The fireproof device 122 is disposed in the cavity of the body 127, and is in contact with the sidewall 121. The fireproof device 122 is spaced from the hopper 14. In use, the fireproof device 122 can prevent articles disposed in the hopper 14 from reacting with air under high temperature, thereby avoiding burning. The fireproof device 122 is optional. In one embodiment, the fireproof device 122 is a fireproof plate.

The collector 123 can be a hollow cylinder. The collector 123 is disposed in the cavity of the body 127 in contact with a top surface of the fireproof device 122. The collector 123 is used for collecting steam generated by a reduction reaction of the articles.

The cooling device 124 can be a circular sleeve in shape. The cooling device 124 is disposed on the outside of the body 127 and covers a part of the sidewall 121 corresponding to the collector 123. The cooling device 124 is used for cooling the collector 123, and condensing the steam collected by the collector 123. The cooling device 124 can be a heat sink with fins, water cooling radiator, or other heat radiating device.

The cover plate 126 covers the opening of the body 127, and is used for encapsulating the hopper 14, the collector 123, and the fireproof device 124 in the reduction pot 12.

Furthermore, the reduction pot 12 can include a pipe 125. The pipe 125 is disposed on the sidewall 121 and adjacent to the opening. The pipe 125 is used for evacuating the reduction pot 12.

The hopper 14 is slidably disposed in the cavity of the body 127 with a slip fit, and below the fireproof device 124. The shape of the hopper 14 is not limited, and the shape of the hopper 14 can be similar to the shape of the body 127.

Referring to FIG. 2, the hopper 14 defines a containing space 143 and includes a heat conductive structure 146 received in the containing space 143. The containing space 143 is defined by a clapboard 142 and a side plate 144. The side plate 144 is connected to the clapboard 142 and extends along a direction perpendicular to the clapboard 142 from an edge of the clapboard 142. The clapboard 142 can rest upon the bottom wall 128 of the reduction pot 12. The side plate 144 can be in contact with the side wall 121 of the reduction pot 12. In one embodiment, the heat conductive structure 146 is disposed on the side plate 144 and extends from the side plate 144 to the containing space 143.

The shape and volume of the hopper 14 are designed according to the shape and volume of the cavity of the body 127. The reduction pot 12 can contain one or a plurality of hoppers 14. When the reduction pot 12 contains a plurality of hoppers 14, the total length of the plurality of hoppers 14 should be less than the effective length of the body 127. The effective length of the body 127 is the total length of the body 127 subtracted by the length of the portion held by the fireproof device 122, the collector 123, the cooling device 124, and the cover plate 126. In one embodiment, the reduction pot 12 contains a hopper 14.

In one embodiment, the clapboard 142 of the hopper 14 is a segment of a circular plate. The clapboard 142 has a circular arc and a straight side connected with two ends of the circular arc. The side plate 144 extends from the circular arc edge along a direction perpendicular to the clapboard 142, thereby forming the containing space 143. The hopper 14 is comprised of a material having good thermal conductivity, high strength, and high rigidity. The melting point of the material of the hopper 14 is higher than the temperature of the reduction reaction. The material of the hopper 14 can be heat resistant steel, carborundum, or silicon nitride. The material of the hopper can be the same as the material of the reduction pot 12. In one embodiment, the material of the hopper is the same as the material of the reduction pot 12, namely, the material of the hopper is thermal resistant steel.

The thickness of the clapboard 142 and the side plate 144 can be set as desired. For saving money, the thickness of the clapboard 142 and the side plate 144 can be decreased under a condition that the hopper 12 cannot be distorted or broken when the articles are loaded in the hopper 14. In some embodiments, the thickness of the clapboard 142 and the side plate 144 is in a range from about 2 millimeters (mm) to about 10 mm.

The central angle of the circle arc of the clapboard 142 is not limited. The central angle can range from about 270 degrees to about 300 degrees. The central angle is related to the quantity of articles loaded in the hopper 14. The larger the central angle, the larger the containing space 143, thereby more articles can be loaded. An opening (not labeled) can be defined by the clapboard 142 and the side plate 144. The articles can be loaded in the containing space 143 through the opening.

Furthermore, the clapboard 142 or the side plate 144 can have a plurality of apertures 145. The apertures 145 are uniformly distributed in the clapboard 142 or the side plate 144. The diameter of the apertures 145 can be designed according to the diameter of individual articles, in which case the diameters of the apertures 145 should be less than the diameter of the individual articles, thereby avoiding leakage of the articles from the apertures 145. The shape of the apertures 145 is not limited. The aperture ratio of the clapboard 142 or the side plate 144 can range from about 30% to about 70%, namely, the total area of the apertures 145 can range from about 0.3 square meter to about 0.7 square meter per square meter of the surface area of the clapboard 142 or the side plate 144. In one embodiment, the shape of the apertures 145 is circular, the diameter of the apertures 145 ranges from 15 mm to 25 mm, and the aperture ratio of the side plate 144 is 50%, namely, the total area of the apertures 145 is 0.5 per square meter of side plate 144. The apertures 145 can save material that is needed for the clapboard 142 or the side plate 144, decrease costs, and decrease the weight of the hopper 14. In addition, the steam generated during the process of the reduction reaction can pass through the apertures 145, thereby increasing the diffusion rate of the steam.

The heat conductive structure 146 includes a plurality of heat conductive elements 1460. The heat conductive elements 1460 are uniformly distributed on the side plate 144 and extend towards the containing space 143. The shape of the heat conductive elements 1460 can be arbitrary, such as plate shaped, or pole shaped. The cross section of the heat conductive elements 1460 having the plate shape can be arbitrary, such as rectangular, triangular, or pentagonal. The cross section of the pole shaped heat conductive elements 1460 can be arbitrarily shaped, such as rectangular, triangular, or pentagonal. The heat conductive element 1460 and the side plate 144 can be integratedly formed, or the heat conductive element 1460 can be disposed on the inside wall of the side plate 144 by welding. The total volume of the heat conductive structure 146 can be in a range from about 0.5% to about 20% of the volume of the cavity 127. In some embodiments, the total volume of the heat conductive structure 146 is in a range from 1% to 10%. In one embodiment, the shape of the heat conductivity element 1460 is columnar, the diameter of the cross section of the heat conductivity element 1460 ranges from about 10 mm to about 35 mm. The heat conductivity elements 1460 are uniformly distributed on the side plate 144. Specifically, the side plate 144 extends from the circular edge of the clapboard 142 along a direction approximately perpendicular to the clapboard 142, thus, the surface of the side plate 144 is a portion of a column surface. The heat conductive elements 1460 can be uniformly disposed on the side plate 144, and approximately perpendicular to a helix on the column surface of the side plate 144. Additionally, the heat conductive elements 1460 can also be disposed on the clapboard 142.

In the process of the reduction reaction of the articles, the heat of the reduction pot 12 can be rapidly transferred from the bottom wall 128 and the side wall 121 to the articles contacted with the bottom wall 128 and the side wall 121. The articles which are not contacting the bottom wall 128 and the side wall 121, will still be rapidly heated because the heat conductive elements 1460 have good thermal conductivity. Thus, the heat conductive structure 146 can increase the heat conductive area of the entire reduction device 10, and decrease the heat conductive distance between the reduction pot 12 and the articles, whereby the articles can be rapidly and uniformly heated to the reaction temperature.

Furthermore, the hopper 14 can include a baffle plate 147. The baffle plate 147 is disposed on an end of the side plate 144, away from the clapboard 142. The baffle plate 147 is opposite to and spaced from the collector 123 and the clapboard 142. The shape of the baffle plate 147 can be set as desired. In one embodiment, the shape of the baffle plate 147 is the same as that of the clapboard 142, namely, the shape of the baffle plate 147 is a segment of a circular plate. The baffle plate 147 is approximately parallel to the clapboard 142. The thickness of the clapboard 142 is not limited. In some embodiments, the thickness of the clapboard 142 ranges from 3 mm to 6 mm. The baffle plate 147 can prevent the articles from leaking from the hopper 14. Additionally, the baffle plate 147 can define a plurality of apertures (not shown). The diameter of the apertures is less than the diameter of the articles particles, to avoid articles leaking from the apertures. The area ratio of the apertures per unit area of the baffle plate 147 is in a range from 30% to 70%. The baffle plate 147 is located below the collector 123, thus, the steam generated during the process of the reduction reaction can pass through the apertures and arrive at the collector 123, thereby increasing the reaction speed. Furthermore, the hopper 14 can include a towing loop 148 disposed on the top surface of the baffle plate 147. The towing loop 148 can be integrally fabricated with the baffle plate 147, or fixed to the baffle plate 147 by welding. The towing loop 148 is used for drawing out the hopper 14 from the reduction pot 12 conveniently. The shape of the towing loop 148 can be set as desired.

In use, the articles are loaded in the hopper 14, then the hopper 14 is pushed into the reduction pot 12. The fireproof device 122 and the collector 123 are disposed in the cavity of the body 127 in that order, then, the cooling device 124 corresponding to the collector 123 is installed on the outer wall of the body 127. The reduction pot 12 is sealed by the cover plate 126. The reduction pot 12 is evacuated by the pipe 125. The reduction device 10 is heated to a desired temperature by a heating device, whereby a reduction reaction of the articles is started. When the reduction reaction is over, the cover plate 126 of the reduction pot 12 is opened, and the collector 123, the fireproof device 122, and the hopper 14 are successively taken out from the reduction pot 12.

When loading the articles, the articles are loaded in the hopper 14, and the hopper 14 is directly loaded in the reduction pot 12. The hopper 14 does not need to be taken out from the reduction pot 12 during the process of the reaction. When the reaction is over, there may be residue left in the hopper 14. To remove the residue, the collector 123, the fireproof device 122, the cover plate 126, and the hopper 14 can be successively taken out from the reduction device 10, and the residue can then be removed. Thus, labor and time is saved over using a heavy reduction pot of the prior art to load the articles in and remove residue from. The hopper 14 is small and lightweight, thus it can be moved easily. Loading and unloading can be done automatically outside the reduction pot 12. Therefore, time and labor is saved by using the hopper 14 in the reduction device 10. Additionally, the hopper 14 can eliminate direct contact between the articles and the sidewall 121 of the reduction pot 12, thereby preventing residue from adhering to the sidewall 121. Accordingly, the lifetime of the reduction pot 12 can be prolonged. The residue adhered elsewhere in the hopper 14 can be easily cleaned out.

Figure 3:
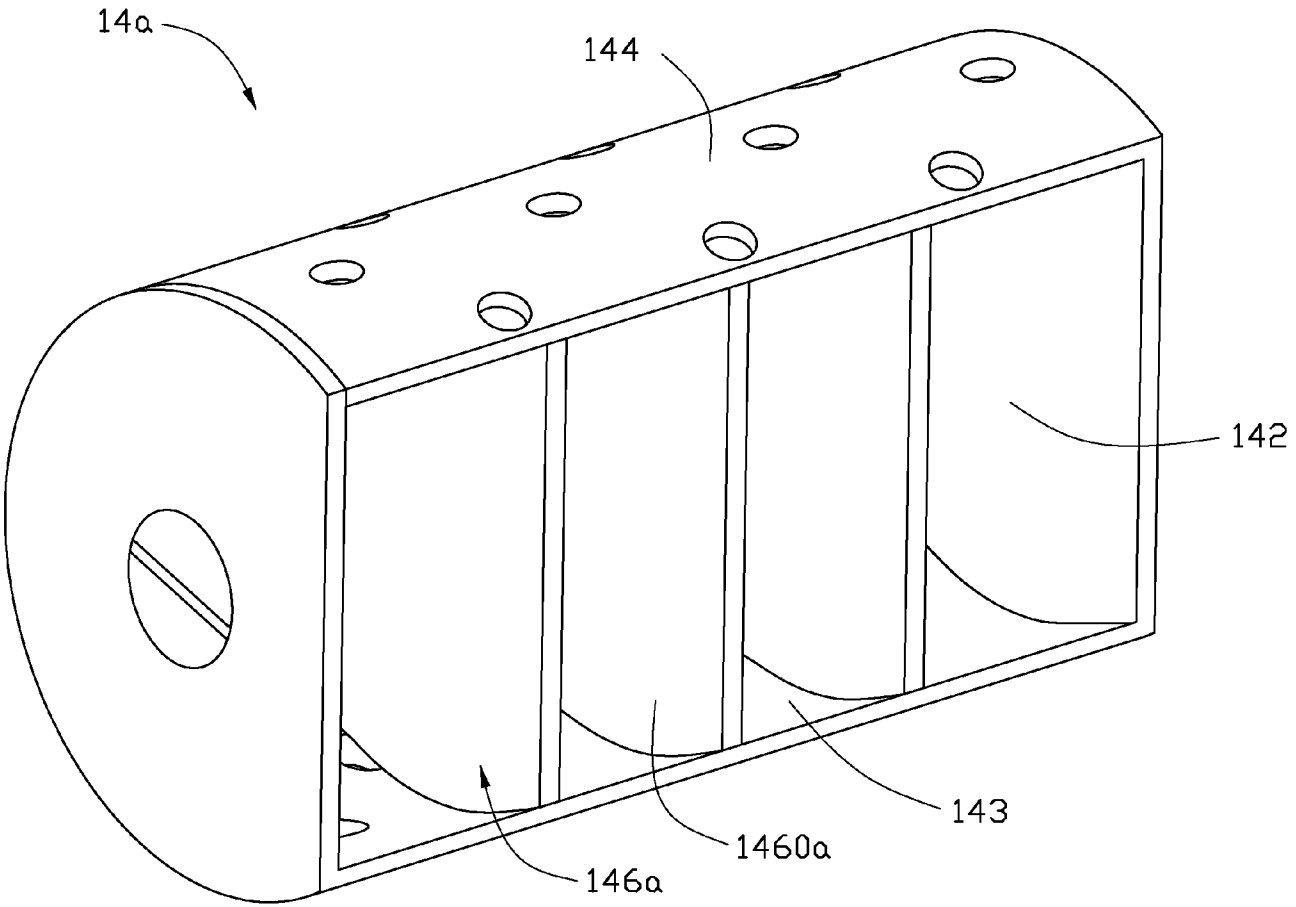
FIG. 3 is a structural schematic view of a second embodiment of a hopper.

A second embodiment of a reduction device includes a reduction pot 14 and a hopper 14*a*. Referring to FIG. 3, the hopper 14*a* includes a heat conductive structure 146*a* different from the embodiment shown in FIG. 2. The heat conductive structure 146*a* includes a plurality of heat conductive elements 1460*a*. Each heat conductive elements 1460*a* is a flat plate, the cross section of the heat conductive elements 1460*a* is shaped as a segment of a circle. The shape and the area of the heat conductive elements 1460*a* are the same as that of the clapboard 142. The heat conductive elements 1460*a* are approximately parallel to the clapboard 142 and spaced from each other. In one embodiment, the plurality of the heat conductive elements 1460*a* are spaced an equal distance from each other, thereby dividing the containing space 143 into a plurality of equal spaces. Furthermore, the heat conductive elements 1460*a* can also be spaced from each other at unequal distances. The thickness of the heat conductive elements 1460*a* can be in a range from about 2 mm to about 15 mm. The heat conductive elements 1460*a* can be fixed on the side plate 144 by welding. In another embodiment, a plurality of grooves can be defined in the side plate 144, thereby fixing the heat conductive elements 1460*a* in the grooves. In one embodiment, the heat conductive elements 1460*a* further support the hopper 14*a*, thereby increasing the strength of the thin hopper 14*a*, and prolonging the lifetime of the hopper 14*a*.

Figure 4:
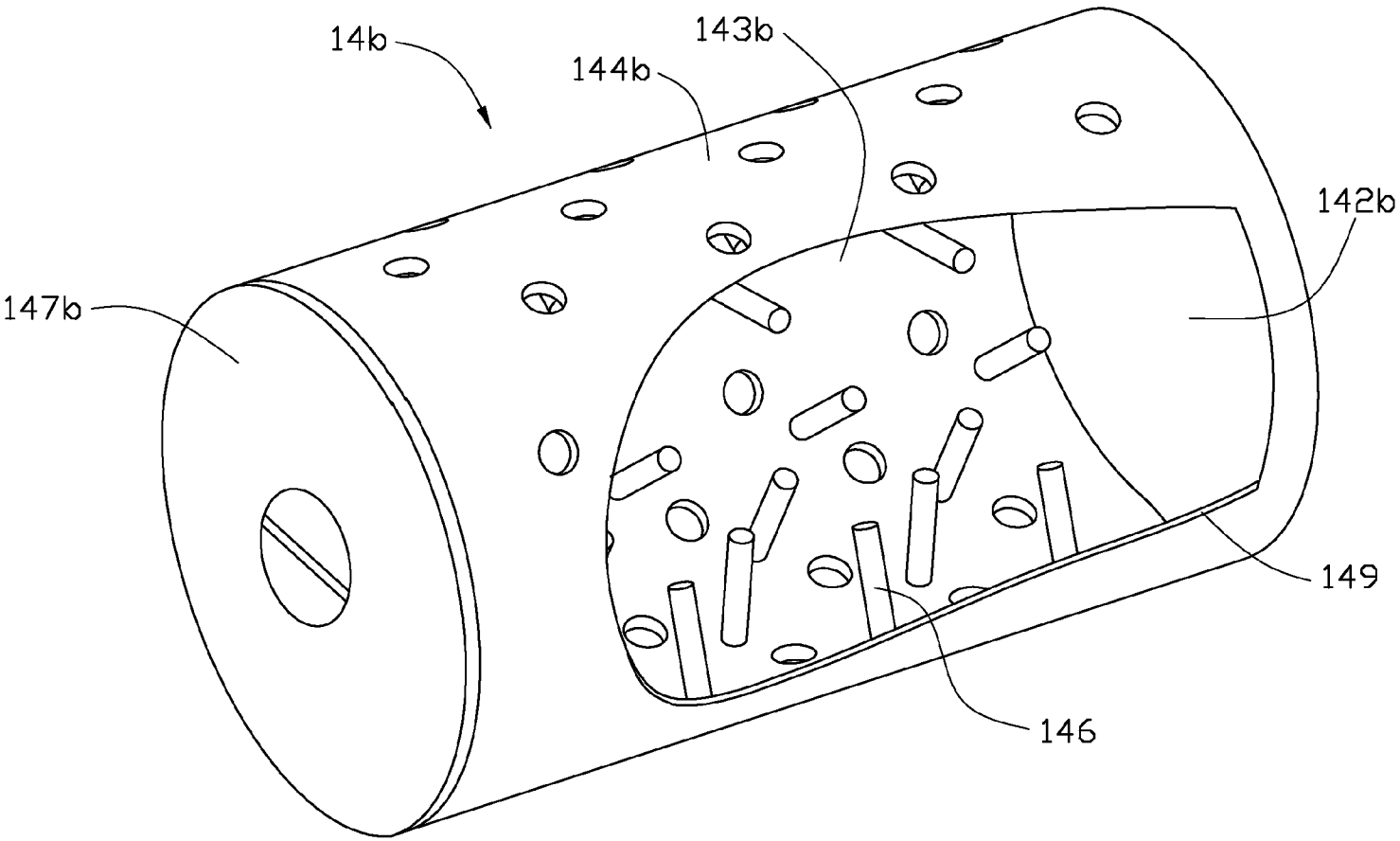
FIG. 4 is a structural schematic view of a third embodiment of a hopper.

A third embodiment of a reduction device includes a reduction pot 14 and a hopper 14*b*. Referring to FIG. 4, the hopper 14*b* includes the clapboard 142*b*, the side plate 144*b*, the baffle plate 147*b*, and the heat conductive structure 146. The clapboard 142*b* has a flat plate structure, and the cross section of the clapboard 142*b* is circular. The side plate 144*b* extends from the circular edge of the clapboard 142*b* along a direction approximately perpendicular to the clapboard 142*b*, thereby forming a columnar containing space 143*b*. The shape of the baffle plate 147*b* is the same as the shape of the clapboard 142*b*, namely, the structure of the baffle plate 147*b* is round and flat. The baffle plate 147*b* is movably disposed on the side plate 144*b*. For example, the baffle plate 147*b* can be connected to the side plate 144*b* by a hook. The baffle plate 147*b* can be opened for loading and unloading the hopper 14*b*. The hopper 14*b* can contain more articles because the hopper 14*b* has a columnar containing space 143*b*.

In one embodiment, the hopper 14*b* further defines an opening 149 in the side plate 144*b* communicating with the containing space 143*b*. The shape and the area of the opening 149 is not limited, in one embodiment, the area of the opening 149 is one fourth of the area of the side plate 144*b*. The opening 149 is convenient for loading the articles and removing residue.

Figure 5:
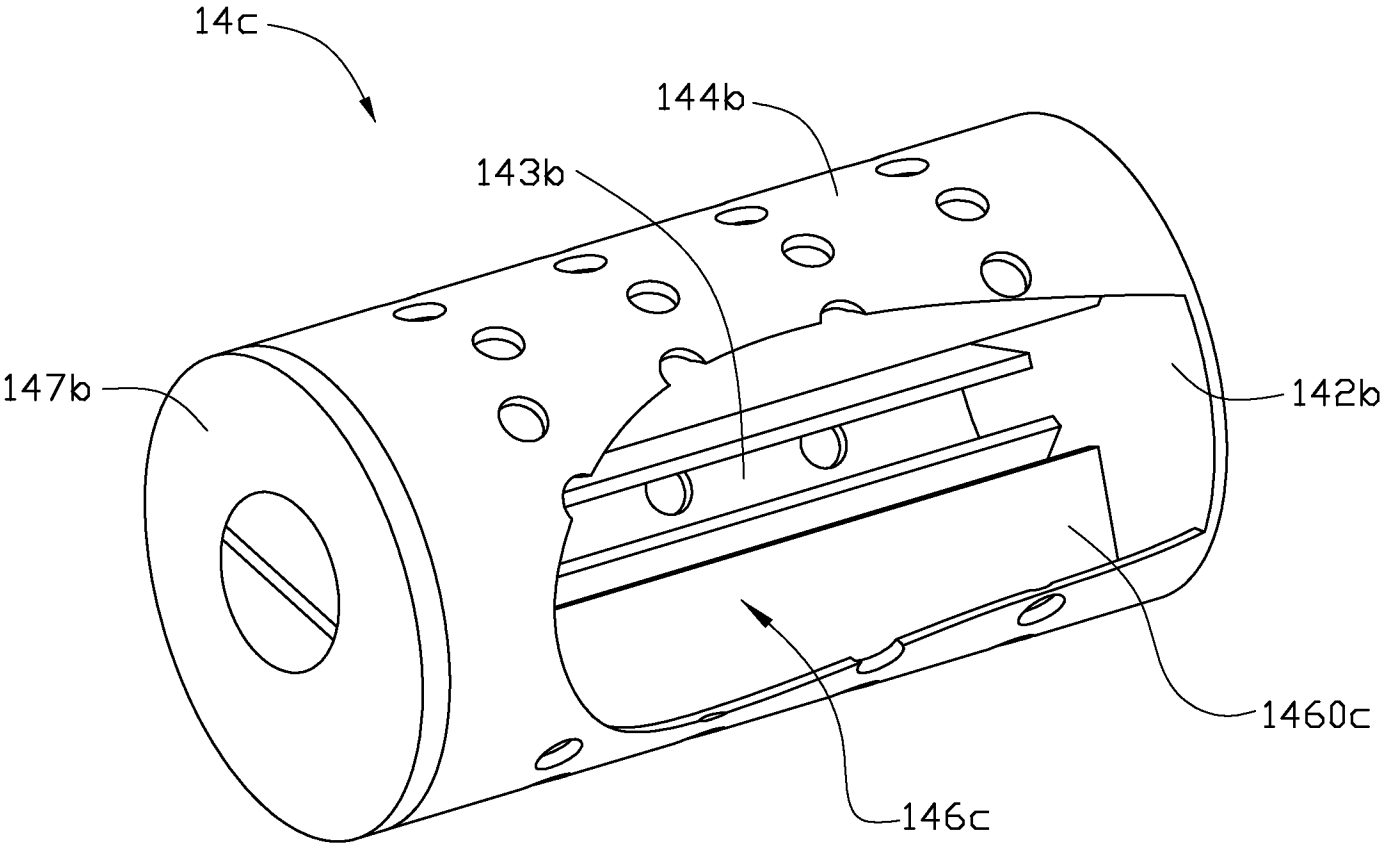
FIG. 5 is a structural schematic view of a fourth embodiment of a hopper.

A fourth embodiment of a reduction device includes a reduction pot 14 and a hopper 14*c*. Referring to FIG. 5, the heat conductive structure 146*c* includes a plurality of heat conductive elements 1460*c*. The heat conductive elements 1460*c* are rectangular and flat. The heat conductive elements 1460*c* are uniformly distributed perpendicularly on the side plate 144*b*. The planes with the heat conductive elements 1460*c* are approximately perpendicular to the planes with the clapboard 142*b*. The heat conductive elements 1460*c* extend from the clapboard 142*b* to the baffle plate 147*b* approximately along the length direction.

Figure 6:
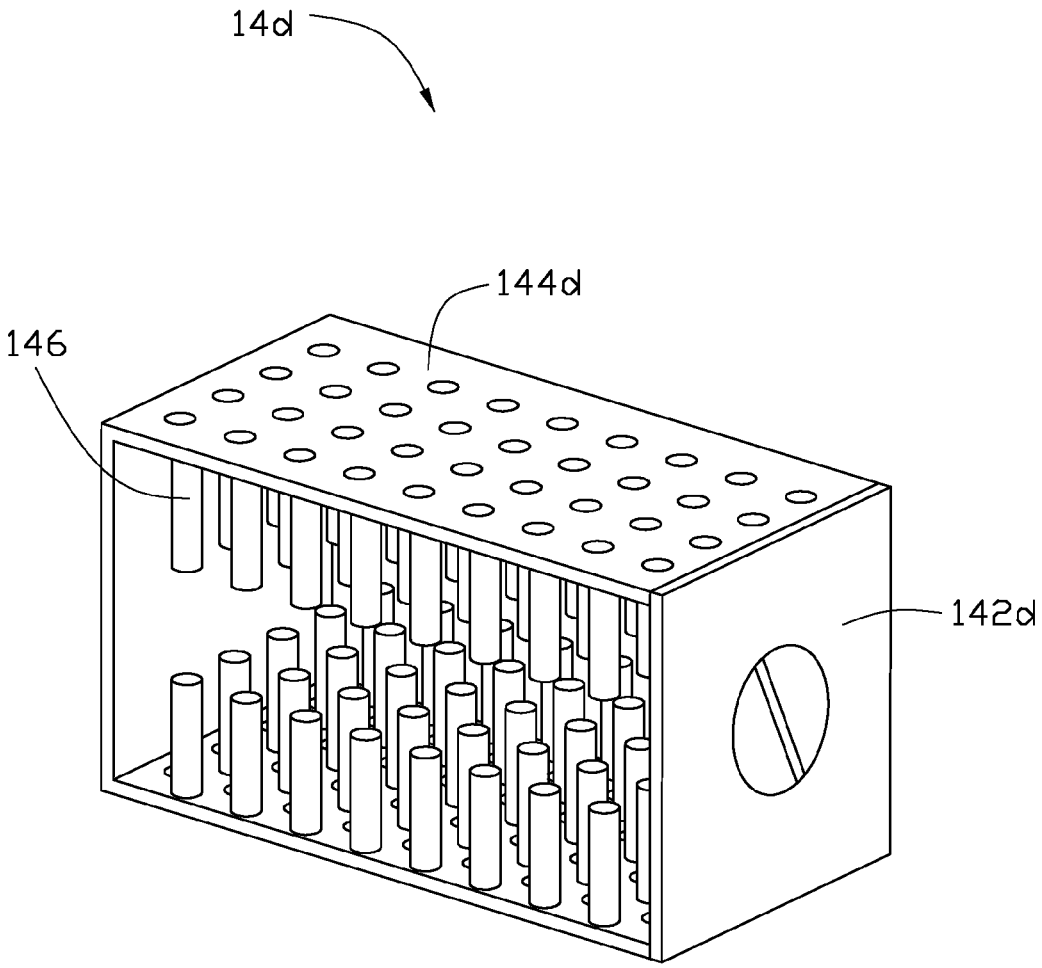
FIG. 6 is a structural schematic view of a fifth embodiment of a hopper.

A fifth embodiment of a reduction device includes a reduction pot (not shown) and a hopper 14*d*. Referring to FIG. 6, the body has a cubic canister-like structure. The hopper 14*d* also has a cubic shape. The clapboard 142*d* is rectangular and flat. The side plate 144*d* extends from the straight edge of the clapboard 142*d* along a direction approximately perpendicular to the clapboard 142*d*.

Furthermore, the shape and the structure of the body, the hopper, and the heat conductive elements are not limited to the above description.

The hopper adopted by the reduction device can be used for loading the articles. The hopper has a small thickness and weight, thus, the hopper is convenient and easy to move. The heat conductive structure increases the heat conductive area of the whole reduction device, thereby increasing the heating speed of the articles in the middle portion of the cavity of the reduction pot, and decreasing energy waste. The hopper has a plurality of apertures. The apertures can save on material costs, decrease the weight of the hopper, and provide a plurality of diffuse passages, thereby increasing reaction speed.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A reduction device for refining a material using thermal reduction comprising:

a body defining a cavity, the body comprising a bottom wall and a sidewall connected to the bottom wall;

at least one hopper adapted to load articles, each individual article having a diameter, wherein the at least one hopper is slidably disposed in the cavity of the body, and the at least one hopper defines a plurality of apertures, a diameter of each of the plurality of apertures is less than the diameter of the individual article to be loaded by the at least one hopper; and a fireproof plate disposed in the cavity and spaced from the at least one hopper, the fireproof plate being in contact with an inner surface of the sidewall and dividing the body into a first compartment and a second compartment, the at least one hopper being disposed in the first compartment further comprising a plurality of heat conductive elements uniformly disposed on an inner surface of the at least one hopper.

2. The reduction device as claimed in claim 1, wherein the heat conductive elements are approximately perpendicular to the inner surface of the at least one hopper.

3. The reduction device as claimed in claim 1, wherein the heat conductive elements are approximately parallel to each other.

4. The reduction device as claimed in claim 1, wherein a shape of the heat conductive elements is plate shaped or a pole shaped.

5. The reduction device as claimed in claim 1, wherein a total volume of the heat conductive elements is in a range from about 0.5% to about 20% of a volume of the cavity.

6. The reduction device as claimed in claim 1, wherein the at least one hopper comprises a clapboard and a side plate extending from an edge of the clapboard, the clapboard and the side plate cooperatively defining a containing space.

7. The reduction device as claimed in claim 6, wherein the at least one hopper further comprises a baffle plate opposite to the clapboard, the side plate is connected to the baffle plate and an opening is defined in the side plate and communicated with the containing space, the opening is configured to load the articles to the at least one hopper and to remove residues from the at least one hopper.

8. The reduction device as claimed in claim 1, wherein an aperture area to an area of the at least one hopper ranges from about 30% to about 70%.

9. The reduction device as claimed in claim 1, further comprising a collector disposed in the second compartment and contacting the fireproof plate, wherein the collector collects steam generated during a reaction process of the articles.

10. The reduction device as claimed in claim 9, further comprising a pipe, wherein the body defines an opening, and the pipe is disposed on the body adjacent to the opening.

11. The reduction device as claimed in claim 10, further comprising a cover plate sealing the cavity and disposed at the opening.

12. The reduction device as claimed in claim 1 further comprising a plurality of hoppers.

* * * * *